US006881468B2

(12) United States Patent
Hoyt et al.

(10) Patent No.: US 6,881,468 B2
(45) Date of Patent: Apr. 19, 2005

(54) PROCESS FOR PRODUCING YARN HAVING REDUCED HEATSET SHRINKAGE

(75) Inventors: Matthew B. Hoyt, Brownstown Township, MI (US); Wendel L. Burton, Arden, NC (US); James R. Bristow, Asheville, NC (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 10/339,407

(22) Filed: Jan. 10, 2003

(65) Prior Publication Data

US 2003/0104162 A1 Jun. 5, 2003

Related U.S. Application Data

(60) Division of application No. 09/252,853, filed on Sep. 8, 1998, now Pat. No. 6,528,139, which is a continuation-in-part of application No. 08/725,420, filed on Oct. 3, 1996, now abandoned.

(51) Int. Cl.[7] ..... B32B 33/00; D02G 3/24; D02G 3/02; D02J 1/02

(52) U.S. Cl. ..... 428/97; 428/92; 442/200; 442/311; 442/364; 28/219; 28/247

(58) Field of Search ..... 428/97, 92, 369, 428/370, 373, 397; 442/209, 311, 364; 28/219, 247

(56) References Cited

U.S. PATENT DOCUMENTS

| | | | | |
|---|---|---|---|---|
| 3,718,534 A | | 2/1973 | Okamoto et al. | |
| 3,803,453 A | | 4/1974 | Hull | |
| 3,843,609 A | * | 10/1974 | Kimura et al. | 528/347 |
| 3,889,028 A | | 6/1975 | Hösterey et al. | |
| 3,955,022 A | | 5/1976 | Sands | |
| 4,297,413 A | | 10/1981 | Sasaki et al. | |
| 4,473,617 A | | 9/1984 | Van Leeuwen et al. | |
| 4,743,505 A | | 5/1988 | Yamada et al. | |
| 4,756,969 A | | 7/1988 | Takeda | |
| 4,997,712 A | | 3/1991 | Lin | |
| 5,125,818 A | | 6/1992 | Yeh | |
| 5,147,704 A | | 9/1992 | Lin | |
| 5,162,074 A | | 11/1992 | Hills | |
| 5,202,185 A | | 4/1993 | Samuelson | |
| 5,244,614 A | | 9/1993 | Hagen | 264/78 |
| 5,294,482 A | | 3/1994 | Gessner | |
| 5,327,714 A | | 7/1994 | Stevens et al. | |
| 5,340,886 A | * | 8/1994 | Hoyt et al. | 525/426 |
| 5,344,297 A | | 9/1994 | Hills | |
| 5,445,884 A | | 8/1995 | Hoyt et al. | |
| 5,468,555 A | | 11/1995 | Lijten et al. | |
| 5,512,355 A | | 4/1996 | Fuson | |
| 5,518,812 A | | 5/1996 | Mitchnick et al. | |
| 5,549,957 A | | 8/1996 | Negola et al. | |
| 5,550,192 A | | 8/1996 | Sheth et al. | |
| 5,597,650 A | | 1/1997 | Mallonee | |
| 5,780,156 A | * | 7/1998 | Hoyt et al. | 428/373 |
| 5,904,982 A | * | 5/1999 | Kent et al. | 428/376 |
| 5,948,528 A | * | 9/1999 | Helms et al. | 428/373 |
| 6,017,478 A | * | 1/2000 | Kent et al. | 264/172.1 |
| 6,528,139 B1 | | 3/2003 | Hoyt et al. | |

FOREIGN PATENT DOCUMENTS

| | | | |
|---|---|---|---|
| EP | 0 860 521 A2 | 8/1998 | D01D/5/34 |

* cited by examiner

*Primary Examiner*—Cheryl A. Juska
(74) *Attorney, Agent, or Firm*—Nixon & Vanderhye P.C.

(57) ABSTRACT

The present invention provides a process for producing yarn having reduced heatset shrinkage. Preferably, the fibers used in making the yarn are bicomponent fibers. The present invention also provides a process for producing yarn having reduced heatset shrinkage at reduced heat temperatures.

11 Claims, No Drawings

PROCESS FOR PRODUCING YARN HAVING REDUCED HEATSET SHRINKAGE

CROSS-REFERENCE TO RELATED APPLICATIONS

This application is a Div of Ser. No. 09/252/853 Sep. 8, 1998 now U.S. Pat. No. 6,528,139 which is continuation-in-part of commonly owned U.S. patent application Ser. No. 08/725,420, filed on Oct. 3, 1996, now abandoned the entire content of which is expressly incorporated hereinto by reference.

FIELD OF THE INVENTION

The present invention relates generally to the field of fibers. More particularly, the present invention relates to a process for producing yarn having reduced heatset shrinkage.

BACKGROUND OF THE INVENTION

Polyamide, particularly nylon 6, has been used extensively as a synthetic fiber. Its structural and mechanical properties make it attractive for use in such capacities as face fiber for carpeting.

Polyamide fibers, yarns, carpets, and fabrics are often heatset using either moist or dry heat to provide the fibers, yarns, carpets, and fabrics with dimensional stability. A steaming unit made by Superba of Mulhouse, France or American Superba, Inc. of Charlotte, N.C. is typical of the equipment employed in heatsetting with moist heat. Typically, the heatsetting temperature for nylon 6 is in the range of 124° C. to 127° C. Polyamide fibers, yarns, carpets, and fabrics often shrink during heatsetting. The typical heatset shrinkage encountered with 100 percent nylon 6 fibers, etc. is about 24 percent to about 32 percent. High heatset shrinkage can hurt carpet wear performance and appearance; therefore, less heatset shrinkage is desirable. One way of obtaining less shrinkage is to heatset nylon 6 fibers, yarns, carpets, and fabrics at a lower temperature. Heatsetting at a lower temperature is advantageous because it provides an environment that is not as harsh and results in a savings of both energy and energy costs. Commonly, however, lower heatset temperatures are undesirable because the resulting carpet product lacks the characteristics of acceptable appearance and wear performance required by the marketplace. For example, the resulting carpet product sometimes shows streaks and chevrons when dyed and may lack properties such as good tip definition and good cover.

SUMMARY OF THE INVENTION

It is, therefore, an object of the present invention to reduce the heatset shrinkage that results during the production of fibers, yarns, carpets, and fabrics.

Another object of the present invention is to reduce the temperature at which fibers, yarns, carpets, and fabrics are heatset while still obtaining a desirable end product.

Thus, according to the present invention, there is provided a process for producing yarn having reduced heatset shrinkage comprising the steps of texturing a yarn of bicomponent fibers having a nylon 6 sheath and a core of a fiber-forming polyolefin selected from the group consisting of polypropylene and copolymers thereof to a spinnerette and applying steam at a temperature to the yarn of bicomponent fibers using a steaming unit, wherein the heatset shrinkage of the yarn of bicomponent fibers is about one third to about one half of the heatset shrinkage of a yarn formed of 100 percent nylon 6 fibers and having steam applied thereto at said temperature.

Most preferably, the bicomponent fibers are concentric sheath/core structures having a polyamide sheath and a polyolefin core, wherein the sheath comprises from about 70 percent by weight to about 85 percent by weight of the fibers. Such bicomponent fibers exhibit desirable physical properties that are comparable to and even better than fibers formed of 100 percent nylon 6. The polyolefin core may optionally include one or more inert organic fillers so as to affect the total fiber density (compensating for the lower density of the polyolefin core as compared to the polyamide sheath).

The above and other objects, effects, features, and advantages of the present invention will become more apparent from the following detailed description of the preferred embodiments thereof.

DETAILED DESCRIPTION OF THE PREFERRED EMBODIMENTS

To promote an understanding of the principles of the present invention, descriptions of specific embodiments of the invention follow, and specific language is used to describe the same. It will nevertheless be understood that no limitation of the scope of the invention is intended by the use of this specific language and that alterations, modifications, equivalents, and further applications of the principles of the invention discussed are contemplated as would normally occur to one of ordinary skill in the art to which the invention pertains.

As used herein, the term "fiber" includes fibers of extreme or indefinite length (i.e., filaments) and fibers of short length (i.e., staple fibers). The term "yarn" refers to a continuous strand or bundle of fibers.

As used herein, the term "bicomponent fiber" refers to a fiber having at least two distinct cross-sectional domains respectively formed of from two or more polymer types. The term "bicomponent fiber" is, therefore, intended to include concentric and eccentric sheath/core fiber structures, symmetric and asymmetric side-by-side fiber structures, island-in-sea fiber structures, and pie wedge fiber structures. Preferred fiber structures according to the present invention are bicomponent sheath/core fiber structures having a nylon 6 sheath and a core comprised of polypropylene or copolymers thereof While the following disclosure will be directed to such a preferred embodiment, the present invention is equally applicable to other bicomponent fiber structures having a polyamide domain and a polyolefin domain.

As used herein, the term "cover" refers to the degree to which the underlying structure is concealed by the surface material. With respect to carpets, cover is the degree to which pile covers the backing. A lack of cover means that, upon visual examination, the backing can be seen.

Broadly, the present invention is a process for producing yarn having reduced heatset shrinkage comprising the steps of texturing a yarn of bicomponent fibers having a nylon 6 sheath and a core of a fiber-forming polyolefin selected from the group consisting of polypropylene and copolymers thereof and applying steam at a temperature to the yarn of bicomponent fibers using a steaming unit, wherein the heatset shrinkage of the yarn of bicomponent fibers is about one third to about one half of the heatset shrinkage of a yarn formed of 100 percent nylon 6 fibers and having steam applied thereto at said temperature.

The polyamides useful to form the sheath of the sheath/core bicomponent fibers of the present invention are those long chain synthetic polymers containing amide (—CO—NH—) linkages along the main polymer chain that are generically known as nylon 6. Suitable polyamides can also be copolymers of nylon 6, as well as other polyamides having heatset shrinkage properties similar to nylon 6 and copolymers thereof.

Importantly, the core of the fibers according to this invention comprises a fiber-forming polyolefin. Preferred polyolefins are polypropylene and copolymers thereof.

Preferably, the sheath comprises from about 70 percent by weight to about 85 percent by weight of the fibers, while the core comprises from about 15 percent by weight to about 30 percent by weight of the fibers. More preferably, the sheath comprises from about 74 percent by weight to about 79 percent by weight of the fibers, and the core comprises from about 21 percent by weight to about 26 percent by weight of the fibers. Weight ratios of the sheath to the core in the fibers may range from about 2.3:1 to about 10:1. A ratio greater than about 3:1 is particularly preferred.

The core may optionally include an inert organic particulate filler material dispersed therein. The filler material must have an average particle size that is sufficiently small to pass through the polymer filter of the spinnerette without affecting filter pressure. In this regard, particulate filler materials having a particle size in the range between about 0.05 $\mu$m and 1.00 $\mu$m, and preferably less than about 0.50 $\mu$mm, may be employed. When used, the filler material may be blended in a melt of the polyolefin core resin prior to the co-melt spinning of the polyolefin core resin and the polyamide sheath resin using conventional melt-blending equipment. For example, the filler material may be introduced via a side arm associated with an extruder that melts the polyolefin and blends the introduced filler material therein upstream of the spinnerette pack.

Suitable particulate filler materials include calcium carbonate, alumina trihydrate, barium sulfate, calcium sulfate, mica, graphite, kaolin, silica, talc, and titanium dioxide. Calcium carbonate is particularly preferred.

The sheath/core fibers may be spun using conventional fiber-forming equipment. For example, separate melt flows of the sheath and core polymers may be fed to a conventional sheath/core spinnerette pack such as those described in U.S. Pat. No. 5,162,074 to Hills, U.S. Pat. No. 5,125,818 to Yeh, U.S. Pat. No. 5,344,297 to Hills, and U.S. Pat. No. 5,445,884 to Hoyt et al., the entire content of each patent being expressly incorporated hereinto by reference. The melt flows are combined in the spinnerette pack to form extruded fibers such as, for example, multi-lobal (e.g., trilobal, tetralobal, pentalobal, or hexalobal), pentagonal, square, etc. fibers, having sheath/core configurations. Preferably, the fibers have a trilobal structure with a modification ratio of at least about 1.4. More preferably, the modification ratio is about 2 to about 4. In this regard, the term "modification ratio" means the ratio $R_1/R_2$, where $R_2$ is the radius of the largest circle that is wholly within a transverse cross-section of the fiber and $R_1$ is the radius of the circle that circumscribes the transverse cross-section.

Conventional steps, such as those known to ones of ordinary skill in the art, may be employed following spinning. For example, the extruded fibers may be quenched, for example with air, in order to solidify the fibers. The fibers may then be treated with a finish comprising a lubricating oil or a mixture of oils and antistatic agents.

Subsequently, the yarn may be drawn and textured to form a bulked continuous filament ("BCF") yarn. A preferred technique involves combining the extruded or as-spun fibers into a yarn and then drawing, texturing, interlacing, and winding the yarn into a package all in a single step, i.e., without intermediate winding after spinning. This one-step method of making BCF yarn is generally known in the art as spin-draw-texturing (SDT). A two-step method wherein the extruded or as-spun fibers are first combined to form a yarn bundle that is wound on a suitable package and are later drawn, textured, and interlaced, and then wound a second time in a separate step may also be used.

The BCF yarns can subsequently go through various processing steps well known to those skilled in the art. For example, the yarn may be twisted into a cabled yarn ("cable-twisted"). After the yarn is cable-twisted, the yarn is heatset ("twistset") by applying steam to the yarn using a steaming unit. In a preferred method of heatsetting the yarn, the steaming unit comprises a steam tunnel with a prebulker manufactured by Superba of Mulhouse, France or American Superba, Inc. of Charlotte, N.C. The yarn first passes into the prebulker, which is operating at a temperature between about 88° C. and about 98° C. The yarn then passes from the prebulker into a cooling chamber and into the steam tunnel where steam is applied to the yarn. The temperature of the steam tunnel is between about 116° C. and about 127° C., preferably between about 118° C. and about 123° C.

Yarns formed according to the present invention, both at typical nylon 6 heatsetting temperatures (i.e., about 124° C. to about 127° C.) and at reduced heatsetting temperatures (i.e., about 118° C. to about 123° C.) exhibit desirable properties, particularly reduced heatset shrinkage, as compared to yarns formed from 100 percent nylon 6 fibers processed at the same heatset conditions. The heatset shrinkage of yarns formed according to this invention is between about 10 percent and 15 percent, preferably between about 11 percent and 14 percent. The heatset shrinkage of yarns formed according to this invention, therefore, is reduced to about one third to one half of the heatset shrinkage of yarns formed from 100 percent nylon 6 fibers.

Carpet may be made from the yarn by conventional carpet-making techniques such as weaving or tufting the fibers into a backing material and binding the fibers to the backing with latex or other adhesives. The carpet may be cut-pile, berber, unlevel loop, level loop, or any other style according to the popular fashion. If desired, the carpet may be in the form of carpet tiles, with or without foam backing. By way of example, in the case of cut-pile carpeting, the yarn is tufted into a primary backing and cut to form cut-pile carpeting. The primary backing material may be woven or nonwoven jute, nylon, polyester, polypropylene, etc. The cut-pile carpeting is dyed to the desired shade. The primary backing is then coated with a suitable latex material such as a conventional styrene-butadiene ("SB") latex, vinylidene chloride polymer, or vinyl chloride-vinylidene chloride copolymers. It is common practice to use fillers such as calcium carbonate to reduce latex costs. The final step is to apply a secondary carpet backing to the latex-based adhesive. The secondary backing may be jute, polypropylene, nylon, polyester, etc. The carpet may be foam backed or not. The carpet of the present invention can be a variety of pile weights, pile heights, and styles. There is not currently believed to be any limitation on the carpet style.

Surprisingly, carpets formed from the bicomponent yarns made according to the present invention at reduced heatsetting temperatures have the characteristics of acceptable appearance and wear performance required by the marketplace. Unlike carpets formed from yarns made of 100 percent nylon 6 fibers when heatset at reduced heatsetting temperatures, the carpets formed from the bicomponent yarns made according to the present invention at reduced heatsetting temperatures have a uniform appearance with good tip definition and good cover. When dyed, the carpets formed from the bicomponent yarns heatset according to the present invention at reduced heatsetting temperatures also lack the streaks and chevrons found in the carpets made from yarns of 100 percent nylon 6 fibers when those are heatset at the same reduced heatsetting temperatures.

While the discussion above has emphasized the fibers made according to the present invention being formed into bulked continuous filaments for the purpose of making carpet fibers, the fibers may also be processed to form fibers for a variety of textile applications such as, for example, fabrics. In this regard, the fibers may be crimped or otherwise textured and then chopped to form random lengths of staple fibers having individual fiber lengths varying from about 1.5 to about 8.0 inches.

Additionally, the fibers may be dyed or colored utilizing conventional fiber-coloring techniques. For example, the fibers of this invention may be subjected to an acid dye bath to achieve desired fiber coloration. Alternatively, the nylon sheath may be colored in the melt prior to fiber formation (i.e., solution dyed) using conventional pigments for such purpose.

The invention will be further described by reference to the following detailed examples. The examples are set forth by way of illustration and are not intended to limit the scope of the invention.

Physical properties for the samples in the Examples below were obtained using the following test procedures:

Linear Density

The linear density of the fibers was determined using ASTM D1907, where the length of the yarn used was 90 cm.

Superba Shrinkage

Percent shrinkage was computed using the linear densities before and after Superba heatsetting of the yarn by the formula:

$$\text{Percent shrinkage} = \frac{|(d_{after} - d_{before})|}{d_{after}} \times 100$$

where $d_{before}$ and $d_{after}$ are respectively the linear densities before and after the Superba heatsetting.

Dry Bulk Development

This test measures skein bulk development of steam bulked carpet yarns that are exposed to dry heat under a light load. Each yarn sample (i.e., 100 percent nylon 6 and the bicomponent yarn) is wound in the form of a skein, and a load of 14 grams ("light load") is attached to the skein. The skein with the light load is exposed to dry heat at a temperature of 149±3° C. for 5 minutes. After 5 minutes of heating, the inside loop length of the skein with the light load attached is immediately measured to the nearest millimeter. An additional 1350-gram load is then placed on the skein (for a total of 1364 grams). After 30±3 seconds, the inside loop of the skein is measured to the nearest millimeter ($L_2$).

Percent dry bulk development is determined using the following equation:

$$\text{Percent dry bulk} = \frac{L_2 - L_1}{L_2} \times 100$$

where $L_1$ is skein loop length with the 14-gram load in centimeters and $L_2$ is skein loop length with the 1364-gram load in centimeters.

Wet Bulk Development

This test measures skein bulk development of steam bulked carpet yarns that are subjected to hot water under a light load. Each yarn sample (i.e., 100 percent nylon 6 and the bicomponent yarn) is wound in the form of a skein, and a tensioning weight equivalent to 0.056 gf/den (0.5 gf/tex) is attached to the skein. The inside loop length of the skein is measured to the nearest millimeter ($L_o$) about 30±3 seconds after attaching the weight to the skein. The tensioning weight is then removed, and a 4.5-gram weight is attached to the skein. The skein with the attached weight is then immersed in a hot water bath for 30 seconds. After 30 seconds, the inside loop length of the skein with the weight attached is measured to the nearest millimeter ($L_f$).

Percent wet bulk development is determined using the following equation:

$$\text{Percent wet bulk} = \frac{L_o - L_f}{L_{2o}} \times 100$$

where $L_o$ is the original loop length of the skein in centimeters and $L_f$ is the final loop length of the skein after wet treatment in centimeters.

Boiling Water Shrinkage

This procedure, which incorporates the principles of ASTM D2259-71, measures the shrinkage of yarn in skein form when exposed to boiling water. The shrinkage of yarn in skein form is defined as the change in loop length of a skein expressed as a percentage of the length prior to exposure to the boiling water.

In this procedure, each yarn sample (i.e., 100 percent nylon 6 and the bicomponent yarn) is wound in the form of a skein, and a tensioning weight is attached to the skein. After 30±3 seconds, the inside loop of the skein is measured to the nearest millimeter ($L_o$). The skein is then immersed in a bath of boiling water for 30 minutes. After 30 minutes, the skein is removed and dried. A tensioning weight is then attached to the skein. After 30±3 seconds, the inside loop of the skein is measured to the nearest millimeter ($L_f$).

Percent boiling water shrinkage is determined using the following equation:

$$\text{Percent shrinkage} = \frac{L_o - L_f}{L_o} \times 100$$

where $L_o$ is the original loop length of the skein and $L_f$ is the final loop length of the skein after treatment.

Elongation and Tenacity

The elongation and tenacity of the yarn were determined using ASTM D2256-97.

Modulus at 5 Percent Extension

The modulus at 5 percent extension was determined using ASTM D2256-97.

EXAMPLE 1 (COMPARATIVE)

Preparation of Nylon 6 Carpet Yarn

Nylon 6 having a relative viscosity of 2.7 relative viscosity in 96% $H_2SO_4$ (BS-700F supplied by BASF Corporation of Mt. Olive, N.J.) is processed through an extruder using zone temperatures of 240° C., 250° C., 260° C., 263° C., and 267° C. The polymer line between the extruder and the polymer metering gear pump is heated to 267° C., as is the spin beam that holds the metering pump and the spin pack. The spin pack extrudes a product with 58 filaments. The cross-section of each filament has a trilobal cross-section.

A lubricating oil is applied to the yarn, and the yarn is processed through two pairs of heated driven rolls. The first pair is operated at 67° C. and 1072 meters per minute. The yarn is then heated and textured (or "bulked") before passing onto the second pair of heated driven rolls operated at 173° C. and 3000 meters per minute. Next, the yarn passes over a pair of non-heated driven rolls operating at 2480 meters per minute and is interlaced. The yarn is then taken up on a tension-controlled winder.

The yarn is then transferred to equipment that twists two single yarns into a cabled ("cable-twisted") yarn. The cabling operation is performed at a spindle speed of 6500 rpm with undulators to input 3.6 twists per inch. The linear density of the non-heatset cabled yarn is 2270 denier.

Upon completion of cabling, the twisted yarn is heatset ("twistset") using a Superba steam tunnel. The steam tunnel includes a prebulker operating between about 88° C. and about 98° C., a six-meter pressurized tunnel operating at 124° C., and three-inch counterbelts at 230 grams per meter belt loading. The steam tunnel is running at a linear speed of 14 meters per minute.

The linear density after heatsetting is 3152 denier. The percent of heatset shrinkage, calculated according to the formula given above, is about 28 percent.

EXAMPLE 2 (INVENTIVE)

Preparation of Nylon 6 Sheath/Polyolefin Core Carpet Yarn

Nylon 6 having a relative viscosity of 2.7 in 96% $H_2SO_4$ (BS-700F supplied by BASF Corporation of Mt. Olive, N.J.) is placed in a primary (or "sheath") extruder. Temperatures in the primary extruder zones are 240° C., 250° C., 260° C., 263° C., and 265° C. The polymer line between the primary extruder and the polymer metering gear pump is heated to 267° C., as is the spin beam that holds the metering pumps and the spin pack. Polypropylene (HG-3760 (an isotactic 18 melt flow index polypropylene homopolymer) from Solvay Polymers of Houston, Tex.) is placed in the secondary (or "core") extruder. The secondary extruder zone temperatures are 190° C., 200° C., 210° C., and 225° C. The polymer line between the secondary extruder and the polymer metering gear pump is heated to 225° C.

The speed of the polymer metering gear pumps is adjusted such that about 25 percent by volume, which represents about 21 percent by weight, of the material delivered to each filament comprises the polypropylene core and about 75 percent by volume, which represents about 79 percent by weight, comprises the nylon 6 sheath. The sheath and core polymers are directed through a spin pack similar to that described in U.S. Pat. No. 5,344,297 to Hills. In particular, the spin pack is one designed to produce a fiber cross-section similar to that illustrated in FIG. 16 of U.S. Pat. No. 5,344,297 (a sheath/core trilobal fiber). The spin pack extrudes 60 filaments. Each filament has a trilobal cross-section.

A lubricating oil is applied to the yarn, and the yarn is processed through a pair of heated driven rolls operating at 50° C. and 1072 meters per minute. The yarn is then heated and textured (or "bulked") before passing onto a second pair of heated driven rolls operating at 175° C. and 3000 meters per minute. Next, the yarn passes over a pair of non-heated driven rolls operating at 2480 meters per minute and is interlaced. The yarn is then taken up on a tension-controlled winder.

The yarn is then transferred to equipment that twists two single yarns into a cabled (or "cable-twisted") yarn. The cabling operation is performed at a spindle speed of 6500 rpm with undulators to input 3.6 twists per inch. The linear density of the non-heatset cabled yarn is 2690 denier.

Upon completion of cabling, the twisted yarn is heatset ("twistset") using a Superba steam tunnel. The steam tunnel includes a prebulker operating between about 88° C. and about 98° C., a six-meter pressurized tunnel operating at 122° C., and three-inch counterbelts at 230 grams per meter belt loading. The steam tunnel is running at a linear speed of 14 meters per minute.

The linear density after heatsetting is 3164 denier. The percent of heatset shrinkage is about 15 percent.

As can be seen from a comparison of Example 1 and Example 2, the heatset shrinkage in Example 2 (inventive) is 13 percent less than the heatset shrinkage in Example 1 (comparative).

EXAMPLE 3 (COMPARATIVE)

Preparation of Nylon 6 Carpet Yarn Heatset at a Reduced Temperature

A carpet yarn is prepared as in Example 1, except that the cable-twisting input level is 4.25 twists per inch. The linear density of the non-heatset cabled yarn is 2737 denier.

The carpet yarn is then heatset as in Example 1, except that the temperature of the six-meter pressurized steam tunnel is 118° C. The linear density after heatsetting is 3174 denier. The percent of heatset shrinkage is about 14 percent. The physical properties of the reduced heatset temperature yarn after heatsetting are listed in Table I below.

Carpet construction in tufting consists of $\frac{1}{8}^{th}$ inch gauge, straight-stitched, $\frac{9}{16}^{th}$ inch cut-pile height in a 30 ounce per square yard face weight.

The cut-pile carpet is then subjected to a continuous dyeing procedure wherein the carpet is passed under a Kuester's Fluidyer, and the dyebath is applied at 350% wet pick-up. The dyebath consists of the following ingredients:

- 0.500 g/L chelating agent (Amquest N from American Emulsions Company of Dalton, Ga.);
- 2.000 g/L dioctyl sulfosuccinate surfactant (Amwet DOSS 70% from American Emulsions Company of Dalton, Ga.);
- 1.000 g/L alkylpolyglycol ether (Hostapur CX NEW from Clariant Corporation of Charlotte, N.C.);
- 1.000 g/L anionic dye leveling agent (48% active diphenyl oxide disulfonate disodium salt) (Arrosperse AC from Arrow Engineering Company of Dalton, Ga.);
- 1.500 g/L ammonium acetate;
- 0.800 g/L alkaline buffer (Alkaflo KDY from SYBRON/Tanatex Company of Wellford, S.C.);
- 0.100 g/L non-silicone defoamers (Depuma 306 from Ciba Specialty Chemicals of Greensboro, N.C.); and
- Acid Tan Dye, which includes of 0.0260 g/L C.I. Acid Orange 156 (Tectilon® Orange 3G 200% from Ciba Specialty Chemicals of Greensboro, N.C.), 0.0255 g/L C.I. Acid Red 361 (Tectilon® Red 2BN 200% from Ciba Specialty Chemicals of Greensboro, N.C.), and 0.0270 g/L C.I. Acid Blue 324 (Telon Blue BGL 200% from DyStar L.P of Charlotte, N.C.).

The carpet is then exposed to steam at a temperature of about 99° C. for 4 minutes. After steaming, a topical fluorochemical stain protector (0.5% 3M "Scotchguard" #1357F provided by 3M of Minneapolis, Minn.) is applied to the carpet. The carpet is then rinsed in cold water and dried.

Although shrinkage is significantly reduced, the carpet produced from this yarn was rated as not having acceptable, appearance and wear performance in that the carpet contained streaks and chevrons and also lacked good tip definition and cover.

EXAMPLE 4 (INVENTIVE)

Preparation of Nylon 6 Sheath/Polyolefin Core Carpet Yarn Heatset at a Reduced Temperature A carpet yarn is prepared as in Example 2, except with a cable-twisting input level of 4.25 twists per inch and a heatset temperature of 118° C. in the six-meter pressurized steam tunnel. The linear density of the non-heatset cabled yarn is 2690 denier.

The carpet yarn is then heatset as in Example 3. The linear density of the cabled yarn after heatsetting is 3019 denier. The percent of heatset shrinkage is about 11 percent. The physical properties of the reduced heatset temperature yarn after heatsetting are listed in Table I below.

Carpet is then constructed and dyed as in Example 3.

The resulting carpet has uniform appearance with good tip definition and good cover. The carpet also lacks streaks and chevrons. The bicomponent yarn produced a carpet that was rated as having acceptable appearance and wear performance as required by the marketplace.

While the heatset shrinkage of both Example 3 (comparative) and Example 4 (inventive), which are heatset at a reduced heatsetting temperature, is lower than the heatset shrinkage of Example 1, the end product of Example 3 does not have acceptable appearance or wear performance because of its streaking and its lack of tip definition and cover. The end product of Example 4, on the other hand, lacks streaks and chevrons and has a uniform appearance with good tip definition and cover despite the use of a reduced heatsetting temperature.

TABLE I

PHYSICAL PROPERTIES OF REDUCED HEATSET TEMPERATURE YARN AFTER HEATSETTING

| | EXAMPLE 3 | EXAMPLE 4 |
|---|---|---|
| Dry Bulk | 6.2% | 7.1% |
| Wet Bulk | 4.0% | 4.5% |
| Boiling Water Shrinkage | 2.5% | 1.9% |
| Elongation | 86.9% | 78.6% |
| Tenacity | 2.56 grams/denier | 2.21 grams/denier |
| Linear Density | 31374 | 3019 |
| Modulus at 5% Elongation | 3.38 grams/denier | 2.87 grams/denier |

While the invention has been described in connection with what is presently considered to be the most practical and preferred embodiment, it is to be understood that the invention is not to be limited to the disclosed embodiment, but on the contrary, is intended to cover various modifications and equivalents arrangements included within the spirit and scope of the appended claims.

What is claimed is:

1. A process for producing yarn having reduced heatset shrinkage comprising the steps of:

(a) texturing a yarn of bicomponent fibers having a nylon 6 sheath and a core of a fiber-forming polyolefin selected from the group consisting of polypropylene and copolymers thereof; and (b) applying steam, using a steaming unit, to the yarn of bicomponent fibers at a temperature sufficient to achieve a heatset shrinkage of the yarn of bicomponent fibers which is about one-third to about one-half of the heatset shrinkage of a yarn formed of 100 percent nylon 6 fibers and having steam applied thereto at said temperature.

2. The process of claim 1, wherein the heatset shrinkage of the yarn of bicomponent fibers is between about 10 percent and about 15 percent.

3. The process of claim 1, wherein the heatset shrinkage of the yarn of bicomponent fibers is between about 11 percent and about 14 percent.

4. The process of claim 1, wherein the bicomponent fibers are multi-lobal carpet fibers.

5. The process of claim 4, wherein the multi-lobal carpet fibers are trilobal.

6. The process of claim 1, wherein the bicomponent fibers are in the form of continuous or staple fibers.

7. The process of claim 1, wherein the yarn of bicomponent fibers comprises bicomponent fibers having distinct co-melt-spun cross-sectional domains comprising:

(a) a nylon 6 domain that comprises from about 70 percent by weight to about 85 percent by weight of the fibers; and (b) a fiber-forming polyolefin domain that comprises bout 15 percent by weight to about 30 percent by weight of the fibers.

8. A carpet comprising a backing material and a yarn of bicomponent fibers made according to the process of claim 1 affixed in the backing material and bound thereto.

9. A carpet comprising a backing material and a yarn of bicomponent fibers made according to the process of claim 7 affixed in the backing material and bound thereto.

10. A fabric comprising the yarn of bicomponent fibers made according to the process of claim 1.

11. A fabric comprising the yarn of bicomponent fibers made according to the process of claim 7.

* * * * *

UNITED STATES PATENT AND TRADEMARK OFFICE

CERTIFICATE OF CORRECTION

PATENT NO. : 6,881,468 B2
DATED : April 19, 2005
INVENTOR(S) : Hoyt et al.

It is certified that error appears in the above-identified patent and that said Letters Patent is hereby corrected as shown below:

Column 3,
Line 24, "0.50 μmm" should read -- 0.50 μm --.

Column 5,
Line 51, "nearest millimeter." should read -- nearest millimeter ($L_1$) --.

Column 6,
Line 15, "$L_{2o}$" should read -- $L_o$ --.

Column 7,
Lines 1 and 57, "textured (or "bulked")" should read -- drawn --.
Lines 3 and 59, "passes" should read -- is bulked and passed --.

Column 9,
Table 1, Example 3, Linear Density "31374" should read -- 3174 --.

Signed and Sealed this

Twenty-ninth Day of November, 2005

JON W. DUDAS
*Director of the United States Patent and Trademark Office*